United States Patent [19]

Brady et al.

[11] Patent Number: 5,018,457

[45] Date of Patent: May 28, 1991

[54] WASTE TREATMENT SYSTEM

[75] Inventors: Jack D. Brady, Fayetteville; Kenny M. Graves; Larry F. Paschke, both of Jonesboro; John M. Golumbeski, Riverdale, all of Ga.

[73] Assignee: Crown Andersen, Inc., Peachtree City, Ga.

[21] Appl. No.: 367,302

[22] Filed: Jun. 16, 1989

[51] Int. Cl.[5] ..... F23J 15/00

[52] U.S. Cl. ..... 110/346; 110/345; 110/215; 110/216; 55/73

[58] Field of Search ..... 110/215, 216, 245, 345, 110/246, 346; 422/168; 423/242, 244; 159/4.02; 55/73

[56] References Cited

U.S. PATENT DOCUMENTS

| | | | |
|---|---|---|---|
| 3,447,492 | 6/1969 | Kreimann et al. | 110/1 |
| 3,473,298 | 10/1969 | Berman | 55/222 |
| 3,619,983 | 11/1971 | Rohr | 55/89 |
| 3,619,985 | 11/1971 | Rohr | 55/89 |
| 3,687,613 | 8/1972 | Rickard | 423/242 |
| 3,691,729 | 9/1972 | DeRooy et al. | 55/70 |
| 3,726,239 | 4/1973 | Burbach | 110/1 J |
| 3,789,109 | 1/1974 | Lyon et al. | 423/481 |
| 3,861,891 | 1/1975 | Noguchi et al. | 55/230 |
| 4,149,859 | 4/1979 | Vigesdal | 55/89 |
| 4,216,053 | 8/1980 | Powell et al. | 159/4.02 |
| 4,251,236 | 2/1981 | Fattinger et al. | 55/84 |
| 4,310,498 | 1/1982 | Malki et al. | 423/242 R |
| 4,472,364 | 9/1984 | Bauerle et al. | 423/244 A |
| 4,473,438 | 9/1984 | Loureiro | 159/4.02 |
| 4,505,719 | 3/1985 | Goeke et al. | 48/202 |
| 4,552,735 | 11/1985 | Iannicelli et al. | 423/242 R |
| 4,559,170 | 12/1985 | Gay et al. | 159/4.02 |
| 4,620,856 | 11/1986 | Rosenberg et al. | 55/73 |
| 4,640,825 | 2/1987 | Rosenberg | 423/242 R |

*Primary Examiner*—Edward G. Favors
*Assistant Examiner*—Denise L. Ferensic
*Attorney, Agent, or Firm*—B. J. Powell

[57] ABSTRACT

Method and apparatus for processing hazardous waste by incinerating the hazardous waste to a temperature sufficient to break down the hazardous waste; directing at least a portion of the exhaust gas stream produced by the incineration through a spray dryer; passing all of the gas stream from the incineration including that portion exiting the spray dryer through a scrubbing and absorbing device to remove particulates and acid gas from the gas stream by contacting the gas stream with a scrubbing and acid gas absorbing slurry or solution; separating a portion of the scrubbing and acid gas slurry or solution after contact with the gas stream as a waste liquor; and spraying the waste liquor into the exhaust gas stream passing through the spray dryer to evaporate the water in the waste liquor and produce a dry residue.

24 Claims, 5 Drawing Sheets

WASTE TREATMENT SYSTEM

BACKGROUND OF THE INVENTION

This invention relates generally to the treatment of hazardous, toxic and infectuous wastes and more particularly to the method and apparatus for incinerating hazardous, toxic or infectuous wastes and cleaning the off gases therefrom without producing any secondary liquid waste.

Hazardous, toxic and infectuous materials are frequently incinerated for disposal. The off gases from the incineration process must, however, be treated to clean the gases and remove any hazardous residues therefrom as well as any other pollutants. Heretofore, the off gases have typically been treated with a liquid in a scrubber with transfers the pollutants to the scrubbing liquid. The scrubbing liquid must then be properly disposed of or, in some cases, treated to concentrate same so that the remaining residue is in a thickened slurry which must then be disposed. As a result these prior art systems have typically been complicated primarily because of the liquid disposal problem associated with these systems.

SUMMARY OF THE INVENTION

These and other problems and disadvantages associated with the prior art are overcome by the invention disclosed herein by providing a hazardous waste treatment system which incinerates the hazardous waste to break down the waste and then cleans the exhaust gases therefrom while producing only a solid waste which can be easily handled and disposed of. The system incorporating the invention is extremely simple in construction requiring no thickeners or similar liquid concentrators to operate.

The system for carrying out the invention includes an incineration subsystem for incinerating different types of materials, especially hazardous and toxic materials; a spray dryer close coupled to the incineration subsystem into which some or all of the hot exhaust gases pass and a separator to remove solids produced in the spray dryer from the exhaust gas stream output from the spray dryer; a particulate and gaseous pollutant removal subsystem to receive the exhaust gas discharge bypassing the spray dryer and also from the separator and clean the exhaust gas discharge with a reaction slurry or solution before being discharged through an exhaust stack. The reaction slurry or solution is selected to react with the gaseous pollutants found in the gas stream. A typical reaction slurry or solution is illustrated as a hydrated lime slurry, however, it will be understood that other alkaline slurries or solutions such as sodium, potassium or magnesium hydroxide solutions can be used. The reacting slurry or solution is circulated within the pollutant removal subsystem while a portion of the reacted slurry or solution is removed either intermittently or continuously as waste liquor or spent solution. This waste liquor or spent solution is discharged back into the spray dryer so that the water in the waste solution or slurry pumped into the spray dryer is evaporated by the sensible heat in gas stream to produce a dry residue collected out of the spray dryer. Only enough of the exhaust gases from the incineration subsystem to dry to the waste need pass through the spray dryer. This leaves the remaining hot exhaust gases available for heating.

To optionally recover heat from the exhaust gas stream as it is being processed, a condensing heat exchanger may be connected between the spray dryer/dust separator and the particulate and gaseous pollutant removal subsystem. The exhaust gases heat the combustion air for the incineration subsystem while condensing liquids from the gas stream. The cooled exhaust gases and the condensate pass into the pollutant removal subsystem for cleaning while the heated air can be used as combustion air or to reheat the discharging gas stream to the exhaust stack. In a very few critical applications, a filter system can be connected between the pollutant removal subsystem and the exhaust stack to separate any particulate still entrained in the gas steam before passage out of the exhaust stack.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

The invention is designed to handle both solid and liquid hazardous, toxic and/or infectuous wastes whether organic or inorganic. The waste may be delivered to the system in drums, jugs or other containers. Some liquids may be supplied from a holding tank network HTN (see FIG. 2). While the relative ratios may vary, it is anticipated that the primary hazardous compounds encountered will be chlorinated hydrocarbons with secondary sulfur containing, phosphorous containing, fluoride containing and/or nitrogen containing compounds.

While other process reaction slurries or solutions such as those containing sodium, potassium or magnesium hyroxide or sodium carbonate may be used in the invention, it is anticipated that hydrated lime (calcium hydroxide) slurries will most often be used due to their lower cost. Such a calcium hydroxide [$Ca(OH)_2$] slurry will react with the acid gases produced by combustion of each of the above hazardous toxic or infectuous compounds to produce calcium chloride [$CaCl_2$]; calcium flouride [$CaF_2$]: calcium sulfite [$CaSO_3$]; calcium phosphate [$Ca_3PO_4$]; or calcium nitrate [$Ca(NO_3)_2$], all of which can then be dried to solids and removed by the invention.

First Embodiment

Figure 1:
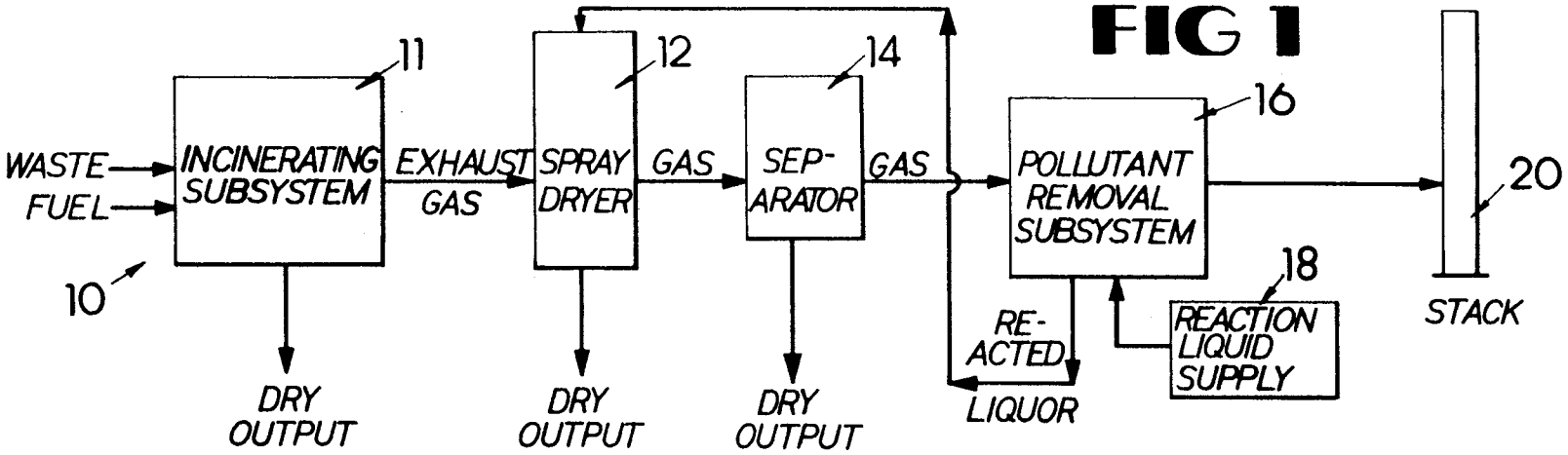
FIG. 1 is a generalized diagramatic flow sheet illustrating one embodiment of the process of the invention.

Referring to FIG. 1 it will be seen that the system 10 incorporates a first embodiment of the invention and includes an incinerating subsystem 11, a spray dryer 12, a particulate separator 14, a pollutant removal subsystem 16 and a stack 20. The incinerating subsystem 11 is charged with the liquid and/or solid waste which is to be disposed. Subsystem 11 incinerates the waste to produce a hot exhaust gas output and a solid ash. The solid ash is removed from the incinerating subsystem 11 and collected for disposal.

At least a sufficient portion of the hot exhaust gas output from the subsystem 11 to operate the spray dryer 12 as will become more apparent is received in spray dryer 12 where the reacted waste liquor from the pollutant removal subsystem 16 cools the exhaust gas stream by evaporative cooling to produce a cooled exhaust gas output and a dry solids output. The exhaust gas output from dryer 12 passes through a dust separator 14 to remove some of the dry particulates from the gas stream, primarily those generated in the spray dryer which pass out with the gas stream from the dryer. Any collected dry particulate in separator 14 is recovered for disposal.

All of the exhaust gas stream, that is, the gas stream output from separator 14 as well as any of the exhaust gas stream from subsystem 11 which by passes the sprayer dryer 12 and separator 14, passes into the pollutant removal subsystem 16 which removes solid, liquid and gaseous pollutants from the gas stream. Subsystem 16 uses one of the process reaction slurries or solutions mentioned above to react with the solids and liquids in the gas stream and to also react with the chemical pollutants in the gas stream to form dissolved and/or suspended solids.

A portion of the process reaction slurry or solution being circulated in the pollutant subsystem 16 is removed as waste liquor so that new makeup reaction process slurry or solution can be added to subsystem 16 to maintain the required unreacted chemical level in the slurry or solution being circulated in subsystem 16 for adequate pollutant removal. The waste liquor from subsystem 16 is sprayed into the exhaust gas stream in the spray dryer 12 to cause the water to evaporate leaving a dry residue containing the pollutants. The vaporization of the water in the waste liquor serves to cool the exhaust gases sufficiently for further processing (usually 400–500° F./204–260° C.) while reducing the subsystem 16 waste liquor to a solid form. The dry particulate removed from the dried reacted liquor is removed from the spray dryer for disposal.

Makeup reaction liquid is supplied from the reaction liquid source 18 to maintain the pollutant reaction capability with the gas stream. It will thus be seen that enough of the exhaust gas stream from the incineration subsystem 11 is directed into the spray dryer 12 to insure evaporation of the water in the waste liquor and the production of a dry solid.

After the gas stream passes out of the pollutant removal subsystem 16, it passes to an exhaust stack 20 where the gas stream is exhausted to the atmosphere.

Figure 2:
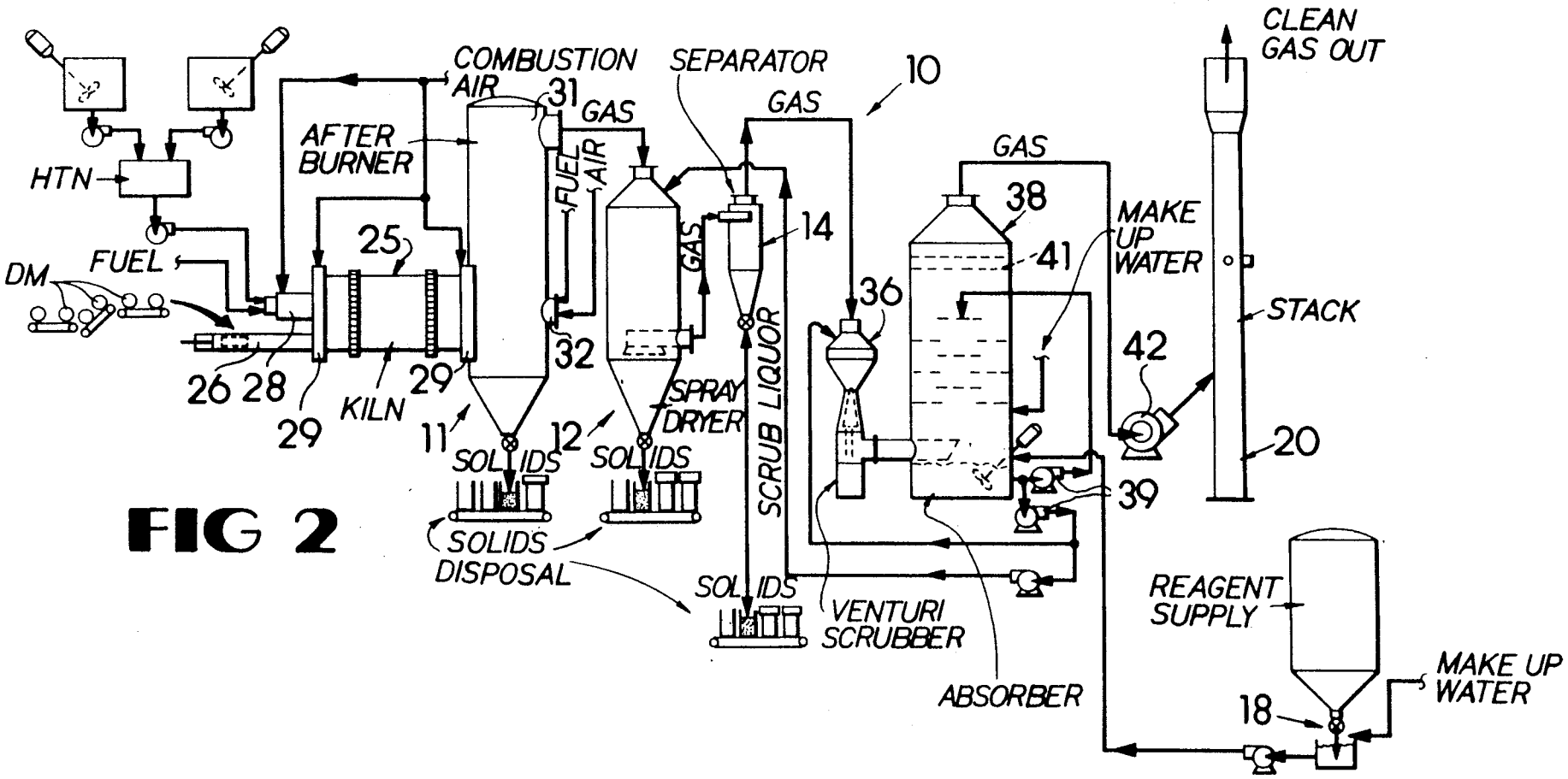
FIG. 2 is a more detailed flow sheet disclosing the embodiment of the invention seen in FIG. 1.

Referring to FIG. 2, a more detailed schematic of the system 10 is illustrated. The liquid waste is usually held in the holding tank network HTN while the solid and semi-solid waste is usually supplied in drums DM.

The incinerating subsystem 11 may incorporate different pieces of equipment as long as such equipment can physically accommodate the waste containers and can also raise the waste to destruction temperature, usually 1800–2500° F. (982–1371° C.). Typically the subsystem 11 includes a primary section and a secondary section. While not intended to be limiting, the subsystem 11 seen in FIG. 2 includes a rotary kiln 25 equipped with a drum feeder 26 and a burner 28. The burner 28 is provided with a conventional fuel source and preheated combustion air from the heat exchanger 15 as will become more apparent. The waste liquid is also typically injected through the burner 28. Primary combustion occurs in kiln 25 with an exhaust gas temperature normally of about 1900° F. (1038° C.) but with temperatures of about 2100° F. (1149° C.) maintained if required for the particular waste. With a 2100° F. (1149° C.) exhaust gas temperature, residence time for gases is about 2 seconds and about 0.5–1.5 hours for solids, depending on the rotational speed and slope of the kiln 25. Gas seals 29 are provided to seal the kiln 25 from significant outside air leakage.

Subsystem 11 also includes a vertical secondary afterburner 31 connected to the discharge of kiln 25. Afterburner 31 has a secondary burner 32 which may be required to further heat the exhaust gases and solids from kiln 25 up to about 2200° F. (1204° C.) normally or as high as 2500° F. (1371° C.) if required to break down the wastes. The ash solids are collected from afterburner 31 and usually drummed into metal drums.

The exhaust gas from afterburner 31 or a portion thereof enters the high temperature spray dryer 12 where the sensible heat in the exhaust gas is used to evaporate the water in the reacted liquor from subsystem 16. The gas temperature is typically taken from 2100° F. (1149° C.) down to about 490° F. (254° C.) in the spray dryer with a temperature drop of about 1200–1900° F. (649–1038° C.) achievable. The reacted liquor is sprayed into the dryer 12 through single-fluid nozzles with differential pressures of about 200–400 psig to finely atomize the liquor, or air or steam atomized two-fluid nozzles to accomplish the same atomization to assure a dry residue collected from the bottom of dryer 12. While the chemical reactions have already occurred in the subsystem 16. any traces of unreacted alkali present will achieve some absorption and adsorption reactions, including reactions with nitrogen oxides, to be completely reacted.

The exhaust gas from the spray dryer 12 passes into the separator 14. While various types of separators may be used, the particular separator 14 illustrated is a cyclonic collector. Most of the dry particulate in the gas stream generated in the dryer 12 and carried out of the dryer in the gas stream is removed by separator 14. The dry particulate recovered in separator 14 is removed from the separator and drummed for disposal from this separator 14.

All of the gas stream originally from subsystem 11 passes into the pollutant removal subsystem 16. While not limiting, the subsystem 16 is illustrated as a variable throat venturi scrubber 36 and a baffle-type absorber 38 connected to the output of the venturi scrubber 36. Typically the scrubber 36 is operated at a differential pressure of about 40 inches W.G. to achieve extremely high particulate and acid gas removal efficiencies. The absorber 38 serves to remove any additional acid gas from the gas stream. The process reaction slurry is circulated by pumps 39 while pump 39 or 40 supplies the waste liquor removed from subsystem 16 to spray dryer 12. A typical pH of about 6.9 is maintained for the process reaction slurry. Thus the amount withdrawn as waste liquor from the slurry circulating in the subsystem 16 is adjusted to maintain the desired chemical composition in the recirculating process reaction slurry.

To remove the residual liquid droplets from the gas stream, a chevron-type or mesh-type (tortuous path, impingement type) mist eliminator 41 is used in the absorber 38. Make up water for the absorber may be added just before the mist eliminator so that the partculates collected by the mist eliminator will be washed away to return the baffle absorber. The gas stream is then exhausted to a induced draft fan 42 and out of stack 20.

Second Embodiment

Figure 3:
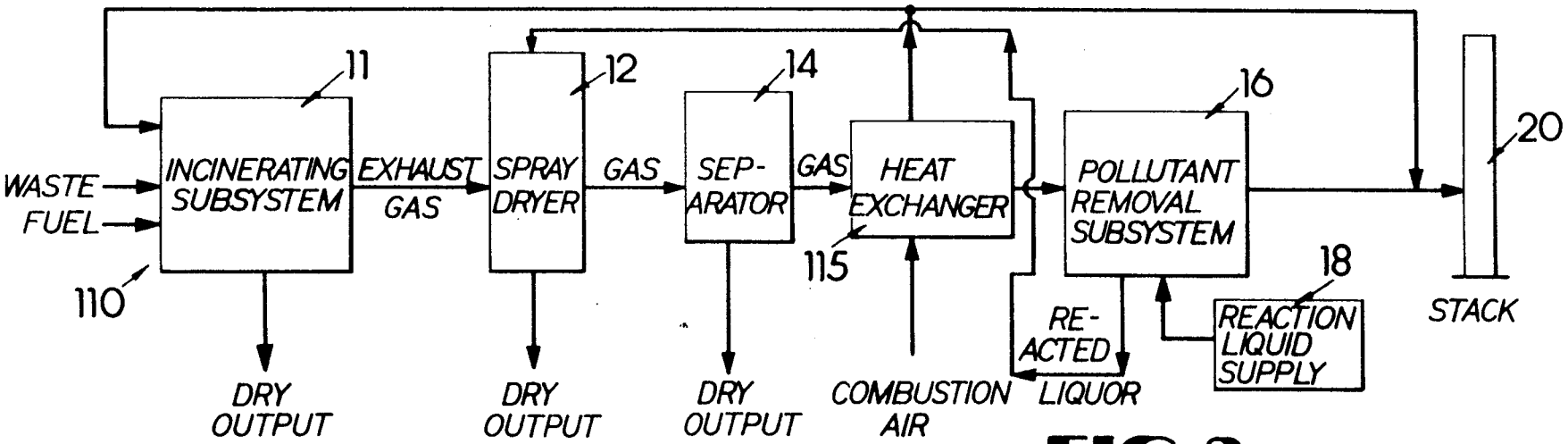
FIG. 3 is a generalized diagramatic flow sheet illustrating another embodiment of the process of the invention.
Figure 4:
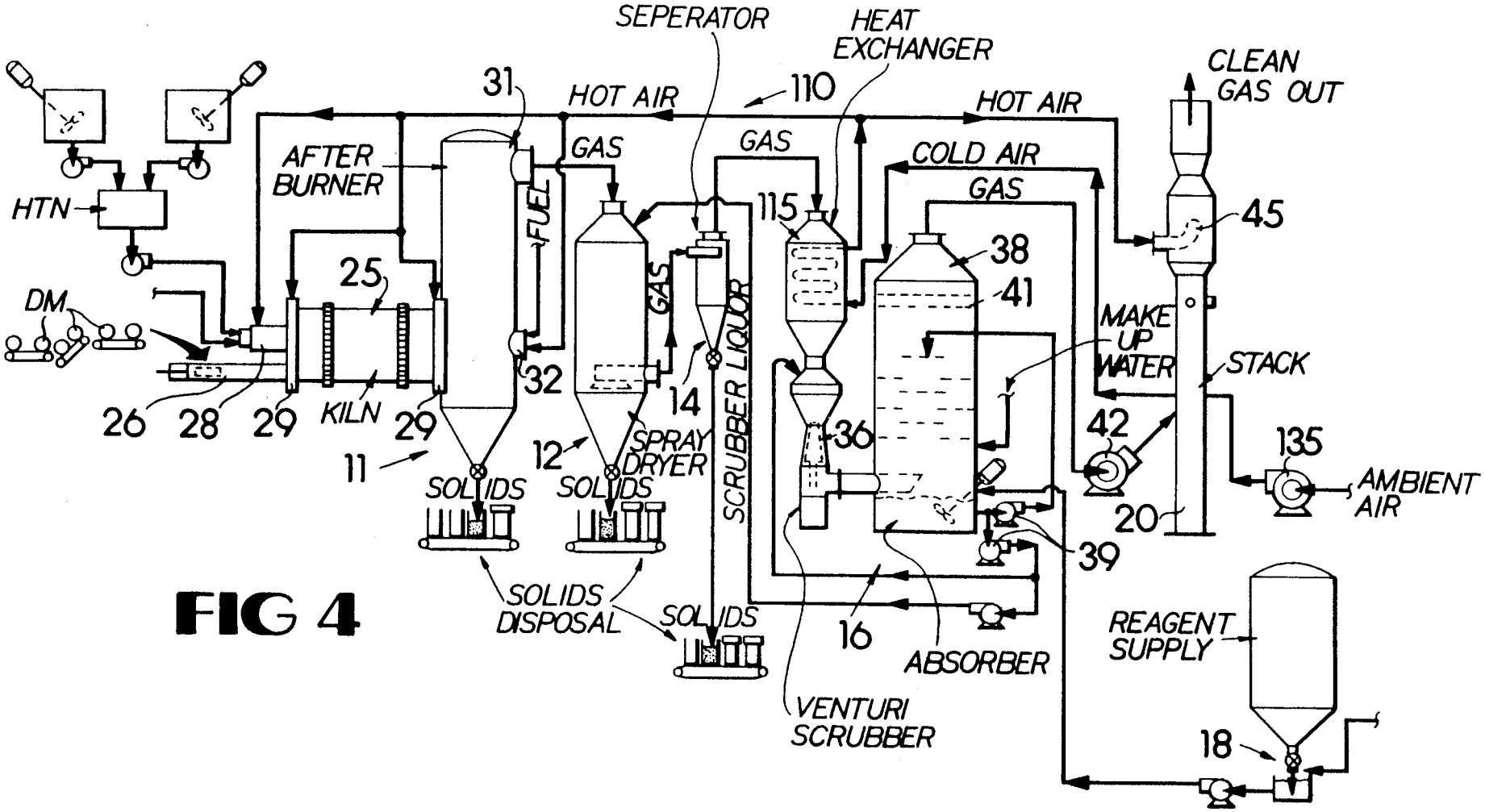
FIG. 4 is a more detailed flow sheet of the additional components of that embodiment of the invention of FIG. 3.

A second embodiment of the invention is illustrated in FIGS. 3 and 4 as system 110. Those components of system 110 common to system 10 have the same reference numbers applied thereto.

The system 110 as seen in FIG. 3 optionally adds a heat exchanger 115 between the separator 14 and the pollutant removal subsystem 16. The gas stream from separator 14 passes through heat exchanger 115 where it is further cooled. Usually below its dew point. The combustion air for the incinerating subsystem 11 also passes through heat exchange 115 in a heat exchange relation with the gas stream to heat the combustion air. The heated combustion air can be directed to the incinerator subsystem 11 to support the incineration process and a portion thereof can be used to reheat the exhaust gases in the stack 20.

As seen in FIG. 4, the gas stream from the separator 14 passes through the heat exchanger 115 in heat exchange relation with combustion air for burners 28 and 32 forced through exchanger 115 by blower 135. Typically, the air is heated up to about 280–400° F. (138–204° C.) and the gas stream is cooled to about 260–120° F. (127–49° C). This can cause heat exchanger 115 to condense water and some acidic compounds in the gas stream. Thus, the heat exchanger must be made out of corrosion resisting materials. The gas and condensate from the heat exchanger both pass into the pollutant removal subsystem 16 where the pollutants are cleansed from both.

The stack 20 may be provided with a mixing tee 45 supplied with hot air from the heat exchanger 115 to raise the gas stream temperature in the stack. This minimizes or eliminates the visible water vapor plume in the discharging gas stream.

Third Embodiment

Figure 5:
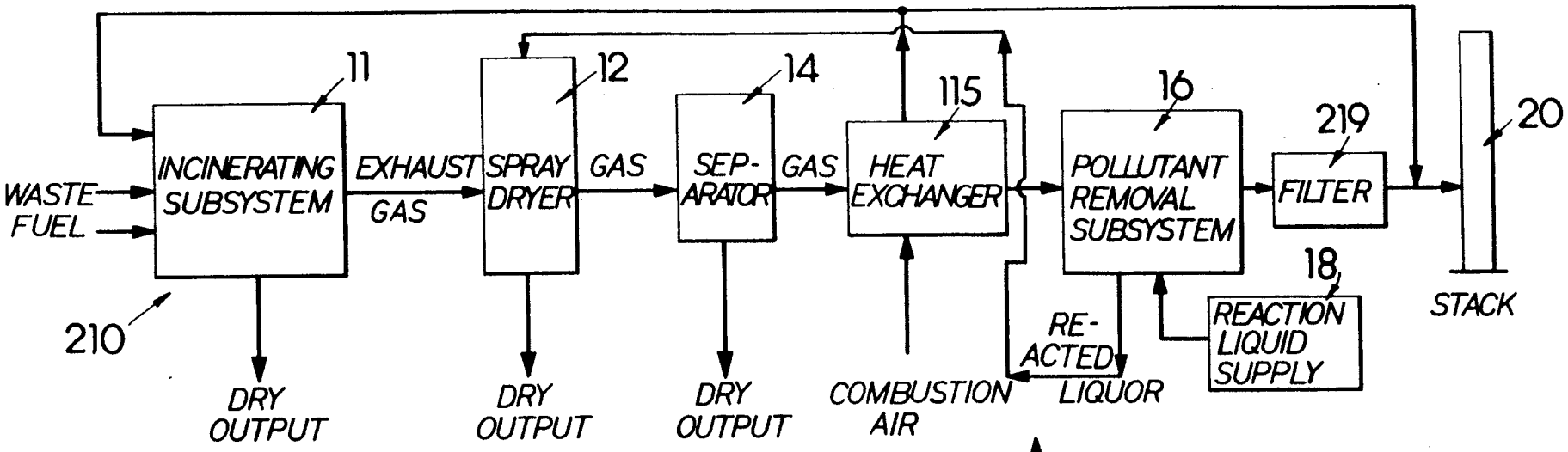
FIG. 5 is a generalized diagramatic flow sheet illustrating a third embodiment of the process of the invention.
Figure 6:
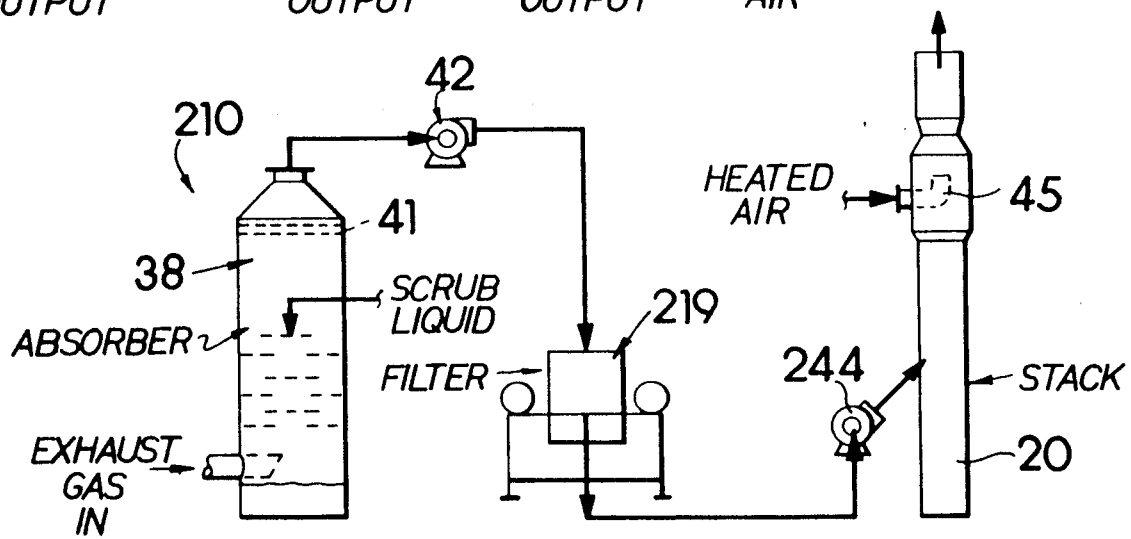
FIG. 6 is a more detailed flow sheet of the additional components of that embodiment of the invention of FIG. 5.

A third embodiment of the invention is illustrated in FIGS. 5 and 6 as system 210. Those components of system 210 common to systems 10 and 110 have the same reference numbers applied thereto. The third embodiment of the invention is used in those applications where any discharge of materials in the exhaust gas stream is critical.

As seen in FIG. 5, a filter 219 is placed between the pollutant removal subsystem and the stack 20. Filter 219 is effective to separate any particulate still entrained in the gas stream.

FIG. 6 is a diagramatic view of only that portion of system 210 directly associated with filter 219. While different filters may be used, filter 219 illustrated is a disposable (fiber type) fiberglass, paper or polyester filter capable of removing submicron particulate matter with over 99% efficiency. Fan 42 discharges into filter 219 while a secondary fan 244 discharges the output from filter 219 into stack 20.

Fourth Embodiment

Figure 7:
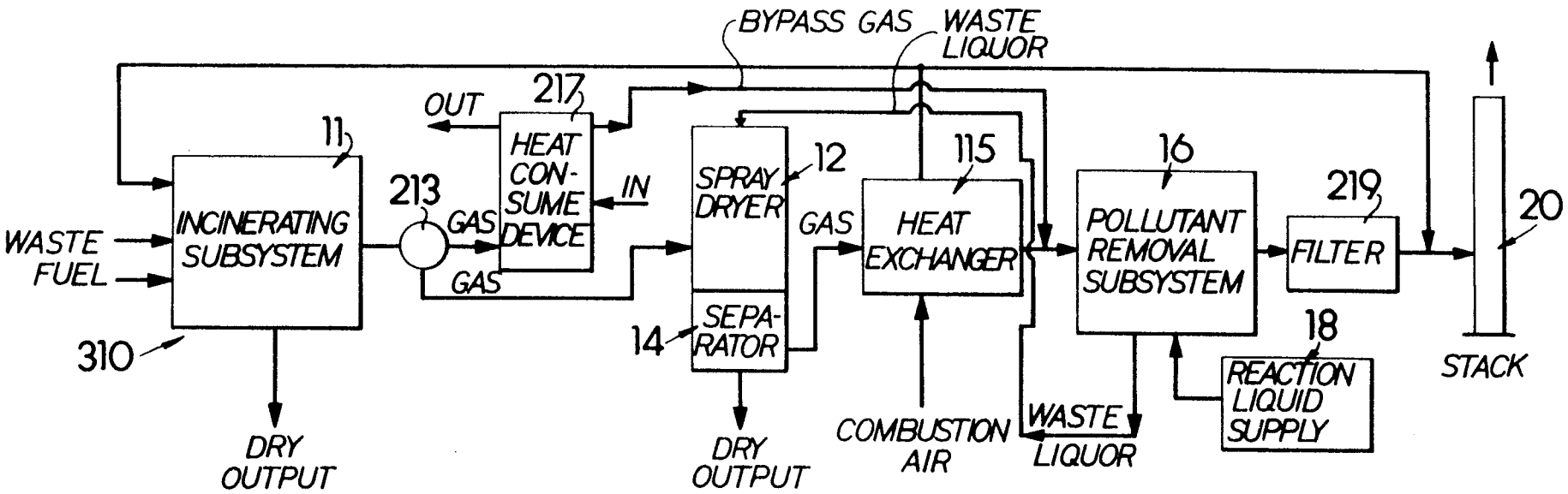
FIG. 7 is a generalized digramatic flow sheet illustrating a fourth embodiment of the process of the invention.

The fourth embodiment of the invention seen in FIG. 7 is designated as system 310. Those components which are the same as system 10 have the same numerals applied thereto. The exhaust gas stream out of the incinerating subsystem 11 is divided in a fixed or variable flow divider device 213 so that part of the gas stream passes into spray dryer 12 while the remainder passes into a heat consuming device 217 such as a steam generator, fluid heater or the like. The heat in the gas stream passing through device 217 is recovered in the working fluid passing therethrough. As mentioned before, a sufficient volume of exhaust gases pass through the spray dryer to insure that all of the water in the waste liquor is evaporated to produce dry solids output.

That portion of the gas stream bypassing the spray dryer 12 passes into the pollutant removal subsystem 16 along with that portion of the exhaust gases passing through the dryer 12. The separator 14 is illustrated combined with the dryer 12.

What is claimed is:

1. A method of processing hazardous waste comprising the steps of:

a) incinerating the hazardous waste to a temperature sufficient to break down the hazardous waste;

b) collecting the solids produced by the incineration step;

c) directing at least a portion of the exhaust gas stream produced by the incineration step through a spray dryer;

d) passing all of the gas stream from the incineration step including that portion exiting the spray dryer through a scrubbing and absorbing device to remove particulates and acid gas from the gas stream by contacting the gas stream with a scrubbing and acid gas absorbing slurry or solution;

e) separating a portion of the scrubbing and acid gas slurry or solution liquid after contact with the gas stream as a waste liquor;

f) spraying the waste liquor into the exhaust gas stream passing through the spray dryer to evaporate the water in said waste liquor and produce a dry residue; and g) collecting the dry residue so that there is no liquid waste output from the system.

2. A system for processing hazardous waste comprising:

incinerator means for incinerating the hazardous waste to a sufficient temperature to break down the hazardous waste, and produce an exhaust gas output;

spray dryer means operatively communicating with said incinerator means to receive at least a portion of the exhaust gas output from said incinerator means, said spray dryer means including spray means for spraying a slurry into the exhaust gas stream to cause water in the slurry to be evaporated and pass out of said spray dryer means with the gas stream;

scrubber means adapted to receive the gas stream output from said incinerator means including that from said spray dryer means; said scrubber means including a scrubbing slurry or solution and contacting means adapted to contact the gas stream in said scrubber means with said scrubbing liquid to clean same; and supply means for supplying a portion of said scrubbing slurry or solution from said scrubber means to said spray means in said spray dryer means to spray said waste liquor into the exhaust gas stream to evaporate the water from said waste liquor leaving a dry residue for collection.

3. The method of claim 1 wherein step d) includes passing the gas stream through a venturi scrubber.

4. The method of claim 3 wherein step b) further includes passing the gas stream through an absorber to further absorb any acid gas in the gas stream.

5. The method of claim 1 further including the step of passing the gas stream through a heat exchanger in heat exchange with combustion air to cool the gas stream after step c) and before step d).

6. The method of claim 5 further including the step of passing the gas stream through a mist eliminator after step d).

7. The method of claim 6 further including passing the gas stream through a filter to remove submicron particulate matter from the gas stream.

8. The method of claim 1 further including the step of passing the gas stream through a separator device between steps a) and c) to remove solids from the gas stream.

9. A method of removing particulates from a heated gas stream comprising the steps of:

a) passing at least a portion of the gas stream through a sprayer dryer;

b) passing the gas stream through a heat exchanger to further cool the gas stream c) subsequently passing the gas through a gas scrubbing device while exposing the gas stream to a scrubbing solution or slurry to clean the gas stream;

d) removing a portion of the scrubbing solution or slurry from the scrubbing device as waste liquor; and e) spraying the scrubber waste liquor into the gas stream passing through the spray dryer to cause the gas stream to evaporate the water in the scrubber waste liquor leaving a dry residue for collection while simultaneously cooling the gas stream.

10. A method of removing particulates from a gas stream with a temperature of about 1800–2500° F. (982–1371° C.) comprising the steps of:

a) passing at least a portion of the gas stream through a spray dryer;

b) subsequently passing the gas stream through a gas scrubbing device while exposing the gas stream to a scrubbing solution or slurry to clean the gas stream;

c) removing a portion of the scrubbing solution or slurry from the scrubbing device as waste liquor; and d) spraying the scrubber waste liquor into the gas stream passing through the spray dryer to cause the gas stream to evaporate the water in the scrubber waste liquor leaving a dry residue for collection while simultaneously cooling the gas stream to reduce the gas stream temperature about 1200–1900° F. (641–1038° C.) in the spray dryer as a result of spraying the scrubber waste liquor into the gas stream.

11. The method of claim 3 wherein step d) includes exposing the gas stream to a scrubbing liquid selected from the group comprising sodium hydroxide, sodium carbonate, potassium hydroxide, magnesium hydroxide and calcium hydroxide.

12. A method of removing particulates from a heated gas stream comprising the steps of:

a) passing at least a portion of the gas stream through a spray dryer;

b) subsequently passing the gas stream through a gas scrubbing device while exposing the gas stream to a scrubbing solution or slurry to clean the gas stream and passing the gas stream through an absorber to further absorb any acid gas in the gas stream;

c) passing the gas stream through a mist eliminator;

d) removing a portion of the scrubbing solution or slurry from the scrubbing device as waste liquor; and e) spraying the scrubber waste liquor into the gas stream passing through the spray dryer to cause the gas stream to evaporate the water in the scrubber waste liquor leaving a dry residue for collection while simultaneously cooling the gas stream.

13. The method of claim 1 wherein step a) includes raising the temperature of the gases to a temperature of about 1800–2500° F. (982–1371° C.) and wherein step c) includes cooling the exhaust gas stream to a temperature of about 400–500° F. (204–260° C.) or less.

14. The method of claim 1 wherein step d) includes passing the gas stream through a venturi scrubber.

15. The method of claim 14 wherein step d) further includes passing the gas stream through an absorber after passage through said venturi scrubber to further absorb any acid gas in the gas stream.

16. The method of claim 15 further including the step of passing the gas stream through a mist eliminator after step d).

17. The method of claim 16 further including the step of passing the gas stream through a heat exchanger in heat exchange with a second fluid stream to further cool the gas stream between steps c) and d).

18. The method of claim 17 further including the step of passing the gas stream through a filter after step e) to remove additional submicron particulate matter from the gas stream.

19. The method of claim 18 further including the steps of discharging the gas stream out of a stack after passage through the filter and injecting at least a portion of the second air stream heated in said heat exchanger in the gas stream in the stack to minimize the visible water vapor plume in the discharging gas stream.

20. The system of claim 2 wherein said scrubber means includes a venturi scrubber for contacting the gas stream with said scrubbing liquid.

21. The system of claim 20 wherein said scrubber means further includes an absorber downstream of said venturi scrubber to contact said scrubbing slurry or solution with the gas stream to further absorb any acid gas in the gas stream.

22. The system of claim 21 further including a mist eliminator down stream of said absorber through which the gas stream from said absorber passes to remove liquid and solid particulate matter from the gas stream.

23. The system of claim 22 further including a heat exchanger located between and communicating with said spray dryer and said venturi scrubber for placing the gas stream in a heat exchange relation with a second fluid stream to cool the gas stream.

24. The system of claim 23 further including a stack through which the gas stream is discharged after passage through said mist eliminator and means for mixing at least a portion of the heated second fluid stream from said heat exchanger with the gas stream in said stack to minimize the visible water vapor plume in the gas stream discharging from said stack.

* * * * *